US007225785B2

(12) United States Patent
Groddeck et al.

(10) Patent No.: US 7,225,785 B2
(45) Date of Patent: Jun. 5, 2007

(54) BOTTOM PLATE FOR A CRANKCASE

(75) Inventors: Michael Groddeck, Meckenbeuren (DE); Joachim Huster, Friedrichshafen (DE); Georg Ruetz, Immenstaad (DE)

(73) Assignee: MTU Friedrichshafen, Friedrichshafen (DE)

( * ) Notice: Subject to any disclaimer, the term of this patent is extended or adjusted under 35 U.S.C. 154(b) by 55 days.

(21) Appl. No.: 11/264,913

(22) Filed: Nov. 2, 2005

(65) Prior Publication Data

US 2006/0096556 A1 May 11, 2006

(30) Foreign Application Priority Data

Nov. 6, 2004 (DE) ..... 10 2004 053 717

(51) Int. Cl.
*F02F 7/00* (2006.01)

(52) U.S. Cl. ..... 123/195 C

(58) Field of Classification Search ..... 123/195 C; 184/106

See application file for complete search history.

(56) References Cited

U.S. PATENT DOCUMENTS

| | | | | |
|---|---|---|---|---|
| 7,066,133 | B2 * | 6/2006 | Groddeck et al. | 123/195 C |
| 2003/0000495 | A1 * | 1/2003 | Groddeck et al. | 123/195 C |

FOREIGN PATENT DOCUMENTS

| | | |
|---|---|---|
| DE | 198 55 562 | 5/2000 |
| DE | 100 33 416 | 6/2001 |

* cited by examiner

*Primary Examiner*—Marguerite McMahon
(74) *Attorney, Agent, or Firm*—Klaus & Bach

(57) ABSTRACT

In a bottom plate for closing the crankcase of an internal combustion engine including coolant and lubricant flow channels integrated into the bottom plate which consists of individual plates stacked on top of one another, a heat exchanger, which consists of heat exchanger plates stacked on top of one another as disposed on the bottom plate so as to form at least one common chamber therewith for transferring at least one of coolant and lubricant between the bottom plate and the heat exchanger.

5 Claims, 4 Drawing Sheets

KS

BOTTOM PLATE FOR A CRANKCASE

BACKGROUND OF THE INVENTION

The invention resides in a bottom plate for closing a crankcase of an internal combustion engine including channels for a lubricant and for a coolant integrated into the bottom plate and a heat exchanger disposed on the bottom plate.

DE 198 55 562 C1 discloses a crankcase including chambers serving as oil storage spaces. DE 100 33 416 C1 discloses a bottom plate for closing that crankcase. With the bottom plate in connection with the crankcase, a dry sump lubrication system is provided. Lubricant as well as coolant channels are integrated into the bottom plate. Generally, this bottom plate consists of cast aluminum. The packing density and free channel length are determined mostly by the smallest core height and the minimum wall thickness. However, manufacturing of such a structure is expensive and structures or means for additional functions can be integrated into the bottom plate only by redesigning a bottom plate to provide one of correspondingly larger size.

Auxiliary equipment such as pumps and heat exchangers are mounted on the bottom plate. A heat exchanger comprises a connector plate with passages for the coolant and the lubricant, stacked heat exchanger plates and a cover plate. The heat exchanger is bolted to the support plate via a support structure. This support structure must be very stable since the arrangement tends to vibrate. At the surface area of the heat exchanger in contact with the support plate a seal is provided.

However, the large weight of the unit comprising the bottom plate and the heat exchanger is critical.

It is the object of the present invention to provide a relatively simple arrangement comprising a bottom plate and a heat exchanger.

SUMMARY OF THE INVENTION

In a bottom plate for closing the crankcase of an internal combustion engine including coolant and lubricant flow channels integrated into the bottom plate which consists of individual plates stacked on top of one another, a heat exchanger, which consists of heat exchanger plates stacked on top of one another as disposed on the bottom plate so as to form at least one common chamber therewith for transferring at least one of coolant and the lubricant between the bottom plate and the heat exchanger.

In comparison with the state of the art, with the design according to the invention, no mounting elements and also no seals between the heat exchanger and the bottom plate are needed. As a result, the weight of the arrangement is reduced and assembly of the arrangement is simplified.

The bottom plate consists of individual plates which are coated at one of their sides with solder. Alternatively, support plates which are coated with solder at both sides may be disposed between the individual plates.

In a particular embodiment of the invention, a second heat exchanger for preheating may be arranged at an $n^{th}$ individual plate of the bottom plate, that is, at that individual plate which closes the bottom plate with respect to the environment. This arrangement provides for the additional advantage that additional functions can be provided without any essential change to the bottom plate.

In the drawings, a preferred embodiment is shown.

DESCRIPTION OF A PREFERRED EMBODIMENT

Figure 1:
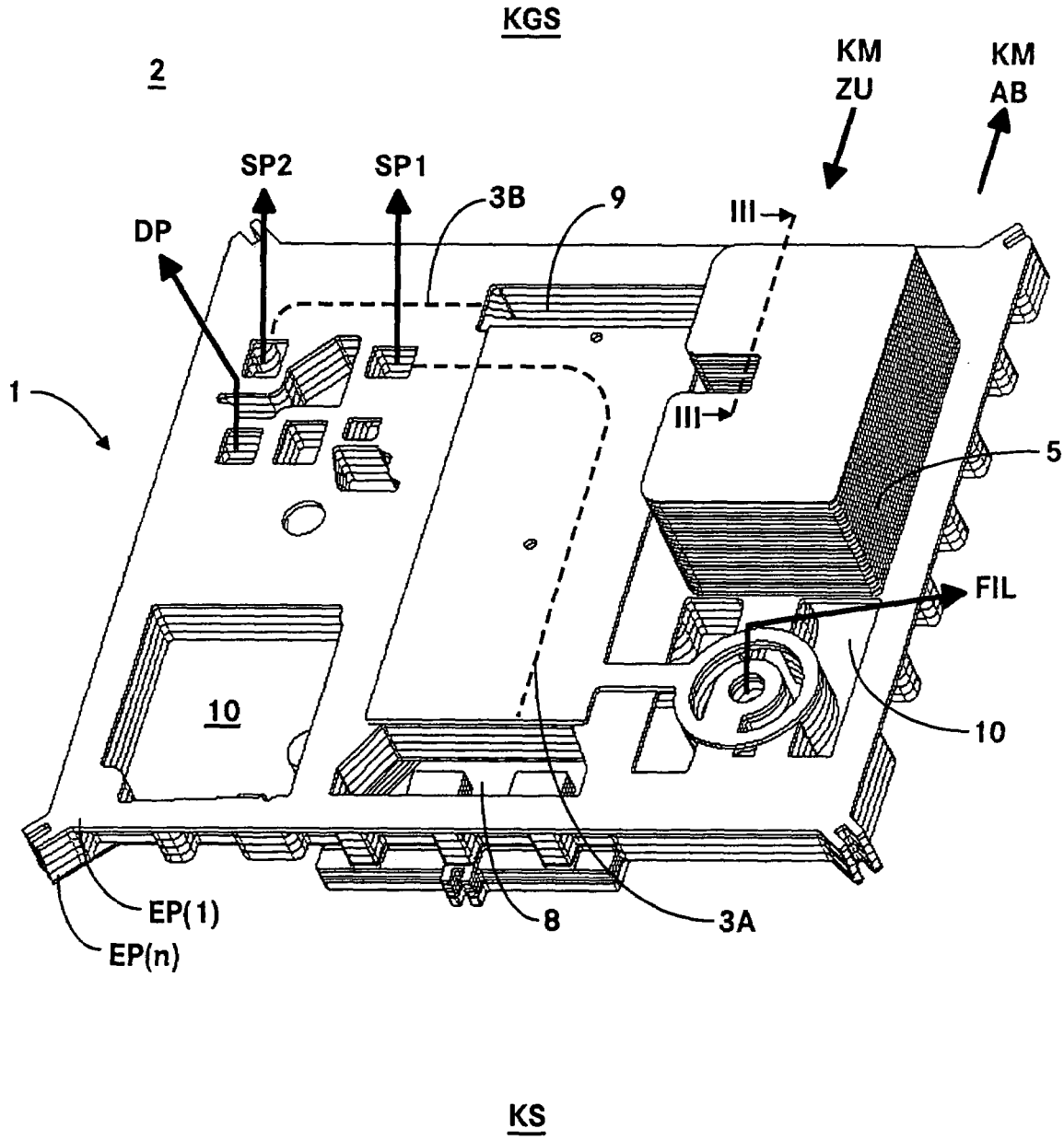
FIG. 1 shows a bottom plate in a perspective view.
Figure 2:
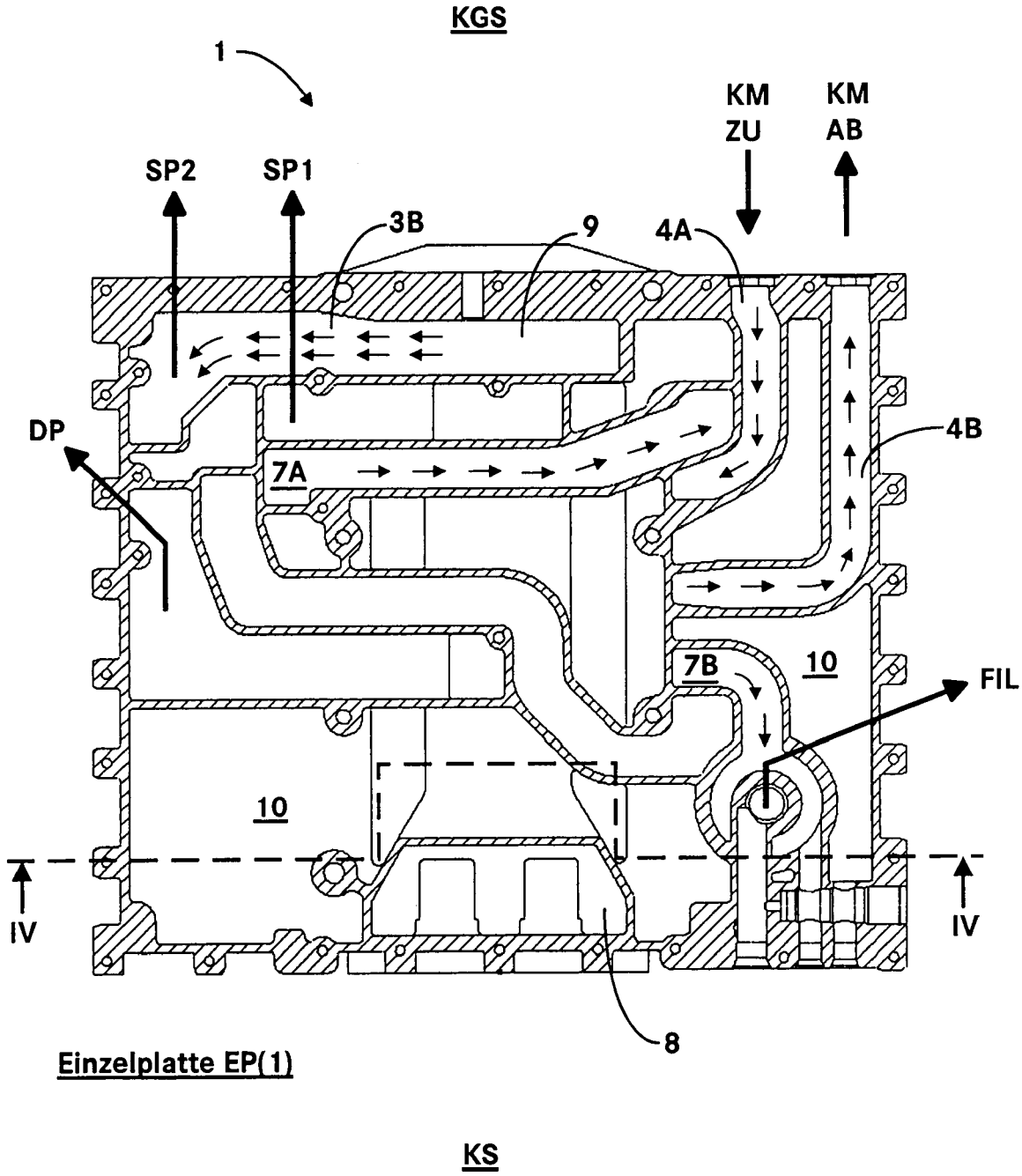
FIG. 2 shows a first individual plate.

FIG. 1 shows a bottom plate 1 in a perspective view. Such a bottom plate is known from DE 100 33 416 C1. The bottom plate 1 closes the bottom end of a crankcase 2 of an internal combustion engine. Herein the bottom plate 1 extends over the whole bottom area of the crankcase 2. By way of the bottom plate 1 in connection with the crankcase 2, a dry sump lubrication system is provided. The lubricant dripping from the crankshaft area flows to a first suction area 8 and a second suction area 9. The first suction area 8 is arranged at the power side KS of the internal combustion engine. The second suction area 9 is arranged opposite side KGS of the internal combustion engine. The lubricant collected in the first and second suction areas is removed by suction pumps SP1 and SP2. FIG. 2 shows the flow directions of the lubricant flows by correspondingly oriented arrows. By an arrow marked DP, a volume flow pumped by a pressure pump is indicated. This flow is conducted via appropriate channels (FIG. 2) to a heat exchanger 5 and an oil filter. The volume flow to the oil filter is indicated in FIG. 1 by an arrow designated FIL. The reference numeral 10 indicates storage chambers for the lubricant. They correspond to respective chambers in the crankcase 2 of the internal combustion engine.

The bottom plate 1 comprises individual plates EP(i) stacked on top of one another. A first individual plate EP(1) is disposed directly underneath the crankcase 2 in abutment therewith. An $n^{th}$ individual plate EP(n) delimits the bottom plate 1 with respect to the ambient. The individual plates may be coated on one side with solder. Alternatively, support plates coated at both sides with solder may be disposed between the individual plates. The support plates have a noticeably smaller thickness than the individual plates. In practice, the individual plates consist of aluminum.

Figure 3:
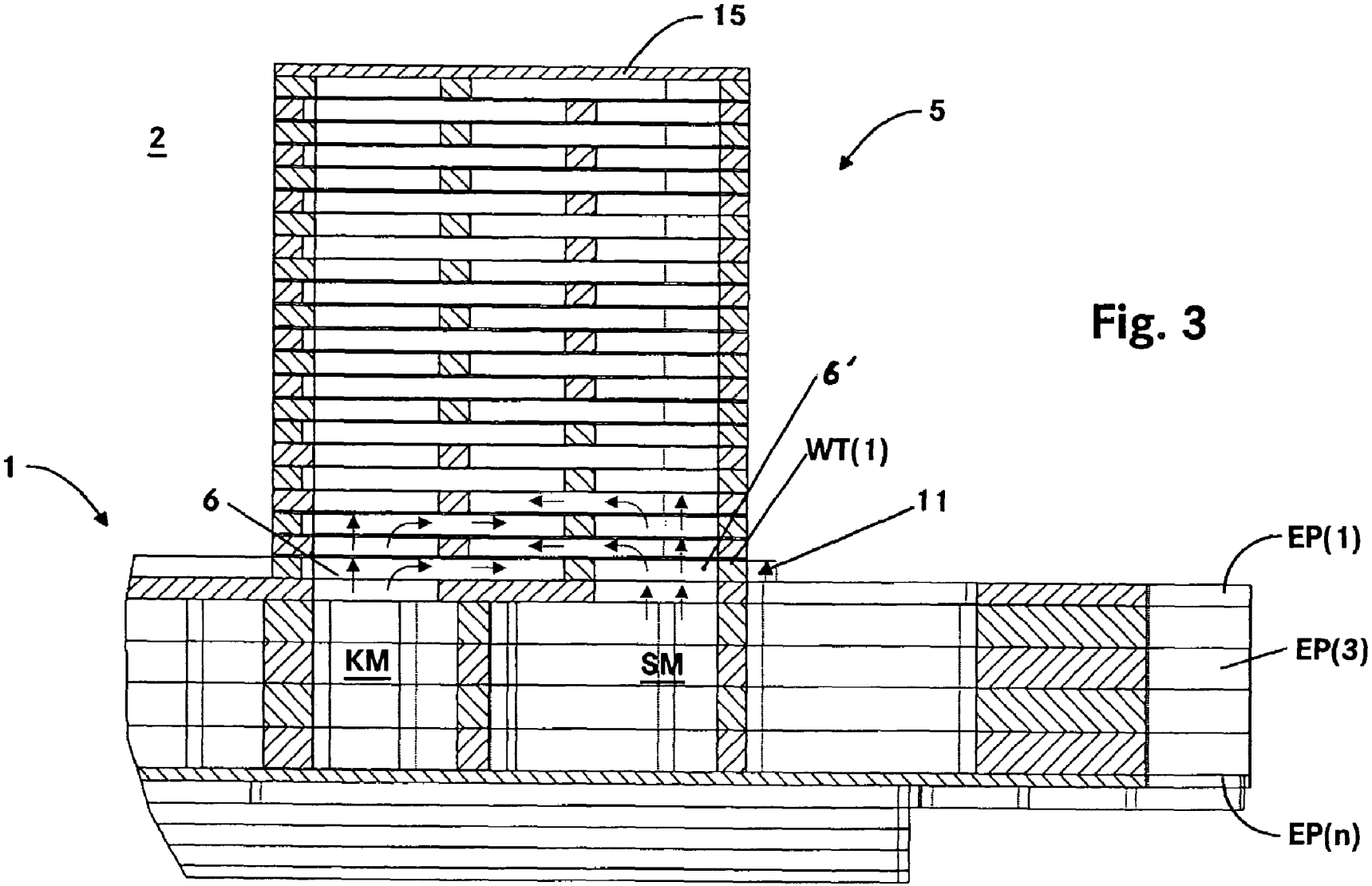
FIG. 3 is a sectional view of the bottom plate and heat exchanger according to FIG. 1.

In FIG. 1, the line III—III indicates a cross-sectional plane through the heat exchanger 5 and the bottom plate 1, which is shown in FIG. 3 and will be explained in connection with this figure. The coolant supply KMZU to the bottom plate 1 and the coolant discharge KMAB from the bottom plate 1 are indicated by respective arrows.

FIG. 2 shows the first individual plate EP(1). It directly abuts the crankcase 2 of the internal combustion engine. The channels of this individual plate are produced by laser cutting or water jet cutting. The coolant supply KMZU is admitted via a channel 4A. After passing through the heat exchanger 5, the coolant is discharged via a channel 4B, see reference sign KMAB. The lubricant volume flow produced by the pressure pump DP is supplied to the heat exchanger 5 by way of a channel 7A. After passing through the heat exchanger 5, the cooled lubricant is conducted via a channel 7B to the oil filter FIL.

Figure 4:
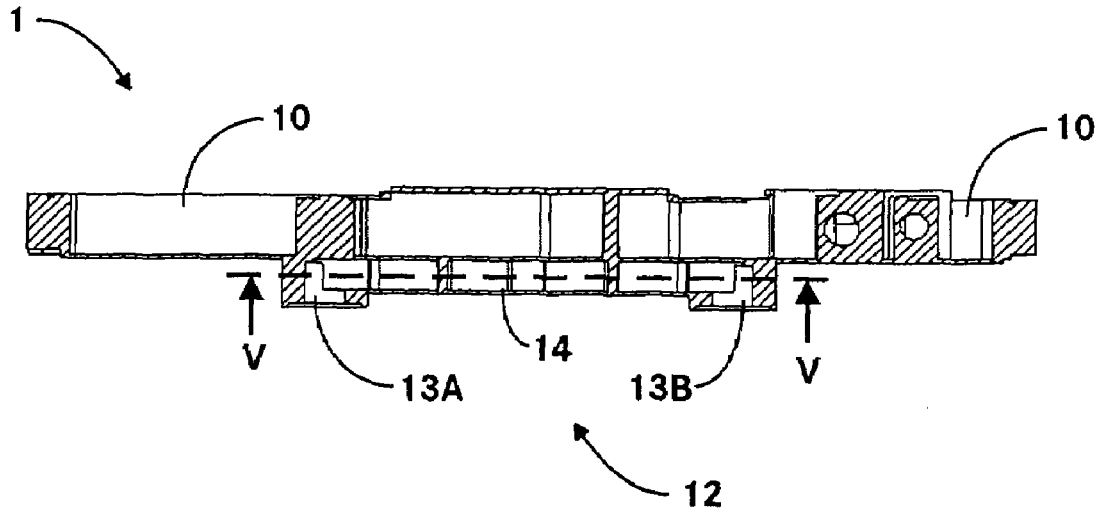
FIG. 4 shows a second heat exchanger.

FIG. 4 is a cross-sectional view taken along line IV—IV of FIG. 2, and will be explained later.

FIG. 3 shows the bottom plate 1 with the heat exchanger 5 in a cross-sectional view taken along line III—III of FIG.

1. As already mentioned, the first individual plate EP(1) directly abuts the crankcase 2 of the internal combustion engine and the $n^{th}$ individual plate EP(n) closes the bottom plate toward the ambient. Just as an example, a third plate EP(3) is designated. As apparent from FIG. 3, the first individual plate EP(1) and the $n^{th}$ individual plate EP(n) are relatively thin since they are designed for loads as generated only for example by the internal pressure.

In practice, the heat exchanger 5 consists of stacked heat exchanger plates WT(i), a top plate 15 forming a top closure and a connecting plate with passage openings for the supply and discharge of the lubricant and the coolant. Such a heat exchanger is mounted on the bottom plate by a rigid support structure. The rigid support structure is necessary since the system bottom plate and heat exchanger system has the tendency to vibrate. At the connection of the heat exchanger with the bottom plate additionally an appropriate sealing structure must be provided.

In accordance with the invention, the first individual plate EP(1) and the first heat exchanger plate WT(1) are abutting each other and form at least one common chamber 6, 6'. In other words: The heat exchanger 5 is connected to the bottom plate 1 without any intermediate plate and is soldered or cemented to the first individual plate EP(1). In this way, a large area connection is obtained, that is, the connecting area 11. The seal element and the support structure are omitted. In the embodiment as shown in FIG. 3, the coolant KM (full line arrows) flows into the common chamber 6. The lubricant flow is indicated in FIG. 1 by dashed lines. The heat transfer from the lubricant to the coolant occurs in a well-known manner at the heat exchanger plates.

Figure 5:
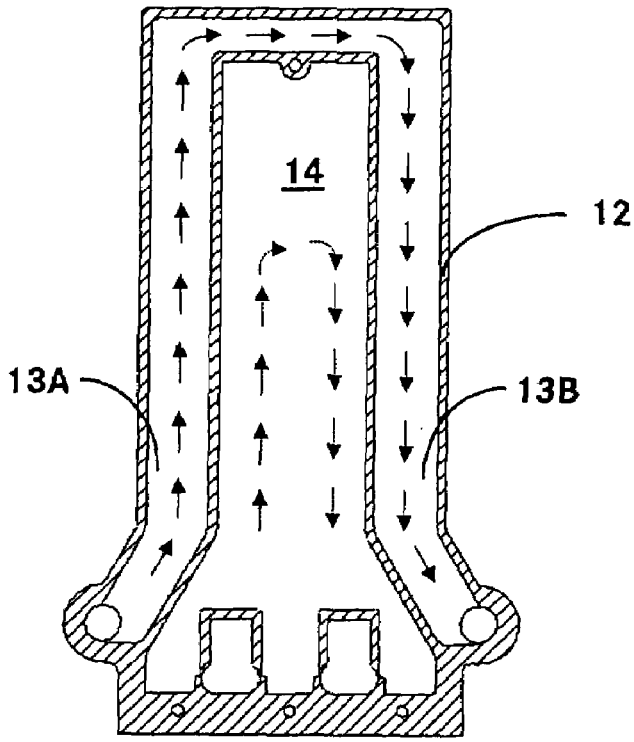
FIG. 5 is a sectional view of the second heat exchanger shown in FIG. 4.

FIG. 4 is a cross-sectional view taken along line IV—IV of FIG. 2. The figure shows a second heat exchanger 12 as will be explained in greater detail in connection with the description of FIG. 5, which shows a cross-sectional view taken along line V—V of FIG. 4. The second heat exchanger serves as a preheater for the lubricant. This heat exchanger 12 is also composed of individual plates stacked on top of one another. This heat exchanger 12 abuts the $n^{th}$ individual plate EP(n). Coolant is supplied to the second heat exchanger 12 via a channel 13A and the coolant is discharged via a channel 13B, see FIG. 5. A corresponding lubricant channel is designated by the reference numeral 14.

The present invention as disclosed herein has the following advantages:

The bottom plate comprises stacked individual plates with channels cut into them whereby a greater packing density is obtained in comparison with a cast individual plate, The first individual plate of the bottom plate and the first heat exchanger plate form a common chamber whereby the connecting plate of the heat exchanger is omitted, the heat exchanger is soldered or cemented to the individual plate whereby further mounting elements and seal elements are not necessary, The heat exchanger can be manufactured in the same way as the individual plates, that is, the channels in the heat exchanger plates can be formed by way of laser cutting or water jet cutting.

What is claimed is:

1. A bottom plate (1) for closing a crankcase (2) of an internal combustion engine, including lubricant and coolant flow channels (3, 4) integrated into the bottom plate (1), and a heat exchanger (5) disposed on the bottom plate (1), said bottom plate (1) consisting of individual plates (EP(i) . . . I=1 . . . n) stacked on top of one another and said heat exchanger (5) consisting of heat exchanger plates (WT(i)) stacked on top of one another on said bottom plate (1), a first individual plate (EP(1)) of said bottom plate (1) and a first heat exchanger plate (WT(1)) of said heat exchanger (5) being disposed adjacent each other and forming at least one common chamber (6, 6'), one of the coolant and the lubricant flow channels (3, 4) being in communication with the respective common chamber (6, 6') for transferring at least one of the coolant (KM) and lubricant (SM) between said bottom plate (1) and said heat exchanger (5).

2. A bottom plate according to claim 1, wherein the first individual plate (WP(1)) of the bottom plate (1) and the adjacent first heat exchanger plate (WT(1)) of the heat exchanger (5) are joined by one of soldering and cementing.

3. A bottom plate according to claim 2, wherein the individual plates (EP(i)) of the bottom plate (1) are coated on one side thereof with a solder.

4. A bottom plate according to claim 2, wherein support plates coated at both sides with solder are disposed between adjacent individual plates (EP(i)) of the bottom plate (1).

5. A bottom plate according to claim 1, wherein for preheating the lubricant a second heat exchanger (12) is arranged on an $n^{th}$ individual plate (EP(n)) of the bottom plate (1) which closes the bottom plate (1) toward the ambient.

* * * * *